United States Patent [19]

Takeuchi

[11] Patent Number: 4,971,659

[45] Date of Patent: Nov. 20, 1990

[54] HEAD BOX WITH REDUCING STREAM GATE

[75] Inventor: Hiroshi Takeuchi, 490-25, Nakano, Fuji-shi, Shizuoka-ken, Japan

[73] Assignees: Hiroshi Takeuchi, Fuji; Hasegawa Machinery Limited, Fuji, both of Japan

[21] Appl. No.: 471,613

[22] Filed: Jan. 29, 1990

[51] Int. Cl.[5] ..... D21F 1/06

[52] U.S. Cl. ..... 162/343; 162/336; 162/344

[58] Field of Search ..... 162/336, 343, 344, 341, 162/216

[56] References Cited

U.S. PATENT DOCUMENTS

| | | | |
|---|---|---|---|
| 4,514,259 | 4/1985 | Koski | 162/336 |
| 4,687,548 | 8/1987 | Ilmoniemi et al. | 162/336 |
| 4,804,441 | 2/1989 | Lyytinen | 162/343 |

FOREIGN PATENT DOCUMENTS

| | | | |
|---|---|---|---|
| 985542 | 3/1976 | Canada | 162/336 |

*Primary Examiner*—Karen M. Hastings

*Attorney, Agent, or Firm*—Wenderoth, Lind and Ponack

[57] ABSTRACT

A head box has a dispersing section provided with a numerous paper material slurry flowing pores at an inlet side of a paper material slurry passage leading to a slurry slip. A reduced stream section is disposed at an outlet side of the dispersing section. The reduced stream section is adapted to reduce the distance of the paper material slurry passage. An evener chamber is formed between an inlet side of the reduced stream section and an outlet side of the dispersing section. A reduced stream gate is disposed at the reduced stream section. The reduced stream gate is adapted to regulate the distance of the reduced stream section. The reduced stream gate is disposed on a bottom surface of the reduced stream section. The reduced stream gate is provided with a shaft portion pivotable about a fixed supporting point and a circular arcuate gate portion formed in concentric with and projected from the shaft portion along a circular arcuate surface of the shaft portion. The reduced stream gate is disposed such that the circular arcuate gate portion is integrally pivoted with the shaft portion to expand an end portion of the gate into the reduced stream section from the bottom surface of the reduced stream section.

2 Claims, 2 Drawing Sheets

HEAD BOX WITH REDUCING STREAM GATE

BACKGROUND OF THE INVENTION

1. Field of the Invention

This invention relates to a head box for flowing a paper material slurry on to a paper forming endless belt in a paper machine.

2. Prior Art

A head box (stock inlet) is located in the very beginning of a wet part in a paper machine. This place becomes one of the most important parts for deciding the texture of paper, etc.

In keeping with the increased paper manufacturing speed and the enlarged paper forming width, the conventional evener roll type inlet was disappeared and a high turbulence head box came to the mainstream.

With regard to the above, various makers adopt their own design. The important part of the construction is that a defuser, which has a numerous paper material slurry flowing pores, is disposed on an inlet side of a paper material passage leading to a slice lip to form a dispersing section, the flowing speed of the paper material slurry flowing through the dispersing section is rapidly increased to create turbulence, thereby to enhance the dispersion of the entire fabric in the paper forming width direction so as to improve a profile in the width direction.

One representative example of the above is that the defuser is formed by uniformly arranging pipes having a small diameter and forming the paper material slurry passage in juxtaposed relation in high density.

However, in order to obtain an initial turbulence by the defuser, it is necessary that the absolute length of the paper material slurry flowing pore or pipe is made sufficiently long or the defuser is provided in a multistage because otherwise the improvement of the profile in the paper forming direction cannot be expected. Such defuser invites a large size of the head box and the manufacturing cost becomes high. Also, if the absolute length of the paper material slurry flowing pore becomes longer, the pressure loss due to friction of the inner wall of the flowing pore becomes larger, and therefore the paper material slurry must be fed by a correspondingly high pump. Since this is contrary to energy saving, there is a demand that the profile effect is obtained at the lowest limit of the flowing speed.

More specifically, in order to uniformalize the profile in the entire paper forming direction, the paper material slurry flowing pores are required to be arranged in high density as much as possible with respect to a section in the paper material slurry flowing direction. However, if the pores are arranged in such high density, we would come up against a dilemma that the flowing speed cannot be increased and a lowering of the turbulence effect is invited. Therefore, there is a limit in improving the profile if only by the defuser.

SUMMARY OF THE INVENTION

It is therefore an object of the present invention to provide a head box in which a dispersing section is disposed on an inlet side of a paper material slurry passage and a reduced stream section for reducing the distance of the paper material slurry passage as will be described hereinafter is disposed on its outlet side so that dispersion and profile improvement can be obtained by means of cooperative actions of the dispersing section and the reduced stream section.

Another object of the present invention is to provide a head box in which the dispersing section is simplified and the simplified dispersing section is offset by a reduced stream section having a structure as will be described hereinafter.

In order to achieve the above objects, there is essentially provided a head box including a dispersing section provided with numerous paper material slurry flowing pores at an inlet side of a paper material slurry passage leading to a slurry slip, a reduced stream section disposed at an outlet side of said dispersing section and which provides a reduced cross section of said paper material slurry passage, an evener chamber formed between an inlet side of said reduced stream section and an outlet side of said dispersing section, a reduced stream gate disposed at said reduced stream section and adapted to regulate the height of said reduced stream section, said reduced stream gate being disposed on a bottom surface of said reduced stream section, said reduced stream gate being provided with a shaft portion pivotable about a fixed supporting point and a circular arcuate gate portion formed in concentric with and projected from said shaft portion along a circular arcuate surface of said shaft portion, said reduced stream gate being disposed such that said circular arcuate gate portion is integrally pivoted with said shaft portion to expand an end portion of said gate into said reduced stream section from said bottom surface of said reduced stream section.

An end face on the expanded side of said circular arcuate gate may be formed by a plane as a tangential line interconnecting a circular arcuate surface of said shaft portion and a circular arcuate portion of said circular arcuate gate portion.

The paper material slurry introduced under pressure into the entrance of the paper forming passage from the tapered header through a pipe flows through the paper material slurry pores of the dispersing section and fed into an evener chamber. Successively, the paper material slurry passes the reduced stream section disposed on its outlet side and directs toward the slice lip. The paper material slurry passes through the flowing pores at an increased speed and its directionarity is solidified. At the same time, the paper material slurry is enhanced to be dispersed due to turbulence generated by the respective flowing pores. Furthermore, as the slurry passes through the narrow space in the paper forming width direction in the reduced stream section at an increased speed, a turbulence is generated by the space to enhance the dispersion. As a result, the paper material slurry profile in the entire width in the paper forming width direction can be improved.

Also, the reduced stream gate is adjusted in accordance with operating conditions such as kind of paper material slurry, freeness, paper manufacturing speed, paper forming width, etc. and an ideal operating condition is properly selected according to necessity.

The above and other objects, features and advantages of the present invention will be well appreciated upon reading of the following description of the invention when taken in conjunction with the attached drawings with understanding that some modifications, variations and changes of the same could be made by the skilled person in the art to which the invention pertains without departing from the spirit of the invention or the scope of claims appended hereto.

BRIEF DESCRIPTION OF THE DRAWINGS

The drawings show one embodiment of the present invention, wherein.

DETAILED DESCRIPTION OF THE PREFERRED EMBODIMENT

Figure 1:
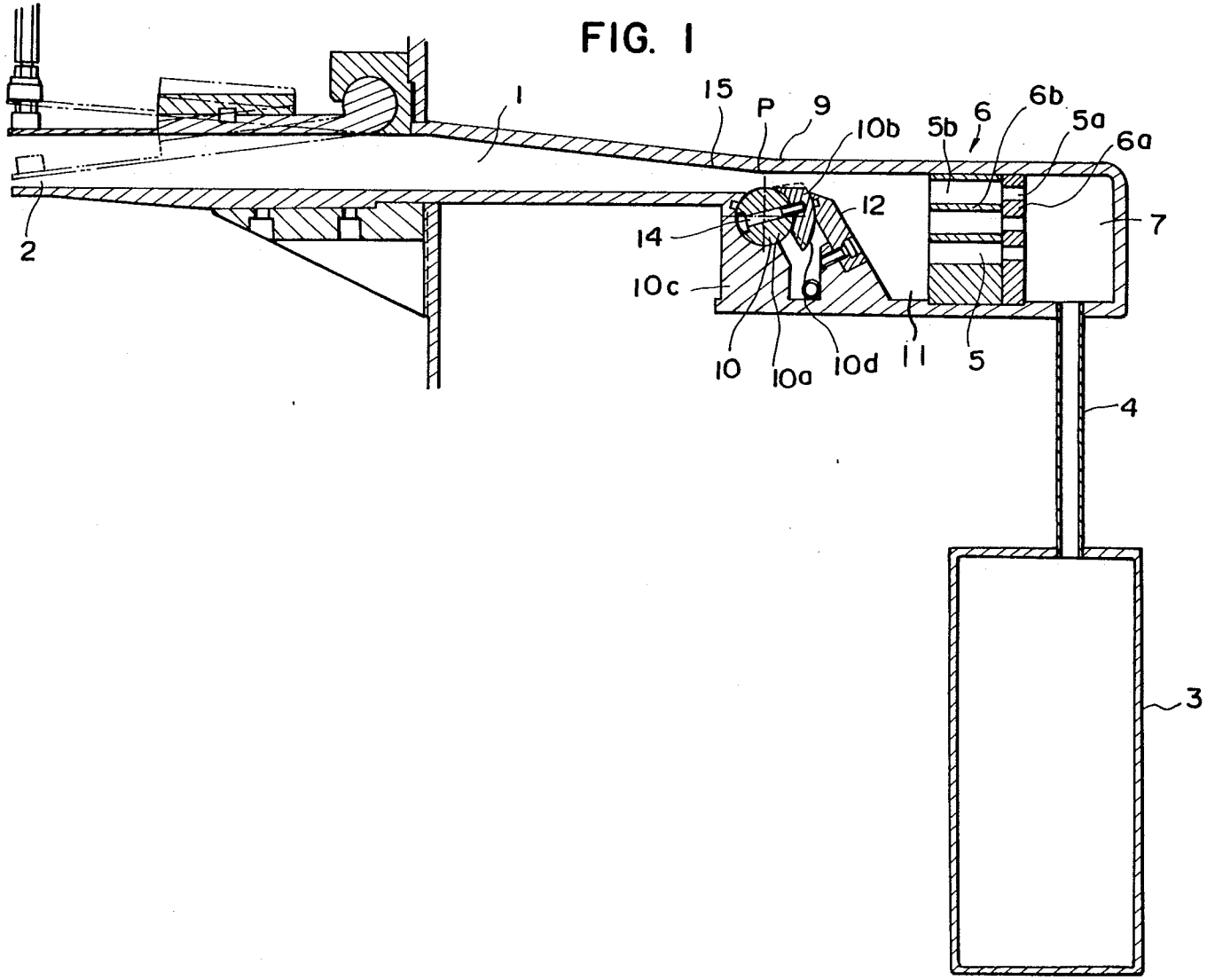
FIG. 1 is a sectional view showing a paper material slurry passage section of a head box.
Figure 2:
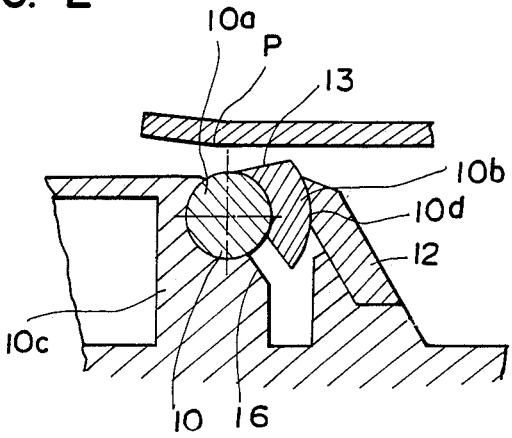
FIG. 2 is a sectional view of a reduced stream section.

One preferred embodiment of the present invention will now be described with reference to the accompanying drawings.

A head box has a paper material slurry passage 1 extending in a generally horizontal direction. The paper material slurry passage 1 is provided on a tip thereof with a slice lip 2 which is adjustable in opening degree and acts as an exit for the paper material slurry. The head box feeds under pressure the paper material slurry to a rear entrance portion from a tapered header 3 through a plurality of pipes 4 arranged in juxtaposed relation in the paper forming width direction.

The paper material slurry passage 1 is provided on its inlet side with a dispersing section 6 having a numerous paper material slurry flowing pores 5 uniformly arranged in the paper forming width direction. The flowing pores 5 of the dispersing section 6 comprises an inlet side porous plate **6*a* penetrating a short paper material slurry flowing pore 5*a* having a small diameter and an outlet side porous plate 6*b* penetrating a long paper material slurry pore 5*b* which is longer than the flowing pore 5*a* and having a large diameter, said flowing pores 5*a* and 5*b*** being coaxially overlapped one upon the other.

The dispersing section 6 has a paper material slurry introducing chamber 7 formed on its entrance side. The paper material slurry is introduced into the paper material slurry introducing chamber 7 from the header 3 and then introduced into the dispersing section 6. The paper material slurry is increased in flowing speed by the short small diameter flowing pores **5*a* first and slightly decreased in flowing speed by the comparatively long large diameter paper material slurry flowing pores 5*b***. By this, a turbulence is generated and the paper material slurry is discharged toward the exit side while being enhanced in its fiber dispersion and directionarity.

On an exit side of the dispersing section 6, there is provided a reduced stream section 9 which provides a reduced cross section of the paper material slurry passage 1. There is also provided a reduced stream gate 10 for adjusting the height of the reduced stream section 9. An evener chamber 11 is formed between an entrance side of the reduced stream section 9 and an exit side of the dispersing section 6. The evener chamber 11 has a large size at its entrance spreading over the opening surface of the flowing pore and is communicated with the reduced stream section 9 at an upper part of its exit side.

The reduced stream gate 10 is disposed on the bottom surface of such arranged reduced stream section 9, i.e., the bottom surface of the paper material slurry passage 1. The reduced stream gate 10 has a shaft portion **10*a* disposed as such that an upper circular arcuate surface thereof is exposed at the bottom surface of the reduced stream section 9 and able to pivot about a fixed supporting point, and a circular arcuate gate portion 10*b* formed in concentric with and projected from the shaft portion 10*a* along the circular arcuate surface of the shaft portion 10*a*. The shaft portion 10*a* is designed such that it is able to pivot while supporting the circular surface by allowing the exit side circular arcuate surface of the reduced stream section 9 to be slip engaged with the circular arcuate surface of a bearing member 10*c*, and an upper arcuate surface of the shaft portion 10*a* is exposed at the bottom surface of the reduced stream section 9 as mentioned above. On the other hand, the circular arcuate gate portion 10*b* is integrally formed with the entrance side circular arcuate surface of the reduced stream section 9 of the shaft portion 10*a* and the shaft portion of the circular arcuate gate portion 10*b* and the circular arcuate surface 10*d* of the concentric circle are slip engaged with the circular arcuate surface of a presser member 12 to support the circular surface, and the reduced stream gate 10 is pivotably held between the bearing member 10*c* and the presser member 12 owing to the circular surface support by the bearing member 10*c* and the circular surface support by the presser member 12**.

In this way, the circular arcuate gate portion **10*b* is integrally pivoted together with the shaft portion 10*a* to cause an upper end of the gate portion 10*b* to be expanded from the bottom surface of the reduced stream section 9 to inside the reduced stream section 9 or retreated to adjust the height of the reduced stream section 9** as shown by the dashed line in the drawing.

The end face on the expanded side of the circular arcuate gate **10*b* is formed by plane 13 as a tangetial line of a shaft portion interconnecting the circular arcuate surface of the shaft portion 10*a* and the circular arcuate surface of the circular arcuate gate portion 10*b*. Similarly, a lower end of the circular arcuate gate portion 10*b* is collided against a part of the bearing member 10*c* thereby to restrict the downward pivotal movement. The numeral 16** denotes a stopper for restricting the downward pivotal movement.

The shaft portion **10*a* is formed of a pure metallic rod, and the circular arcuate gate portion 10*b* is also formed of a pure metallic rod. The portions 10*a* and 10*b* are held in coincidence with each other at their circular surfaces and then integrally jointed together by a bolt 14 to build up the reduced stream gate 10**.

An upper surface of the reduced stream section 9 opposite the reduced stream gate 10 is formed into a rising inclined surface 15 from a position P slightly exceeded the top dead center of the shaft portion **10*a* so as to be shifted to a dilated section of the paper material slurry passage 1. A part of the reduced stream section 9** on the entrance side from the above-mentioned position P is formed into a generally horizontal linear surface.

Figure 3:
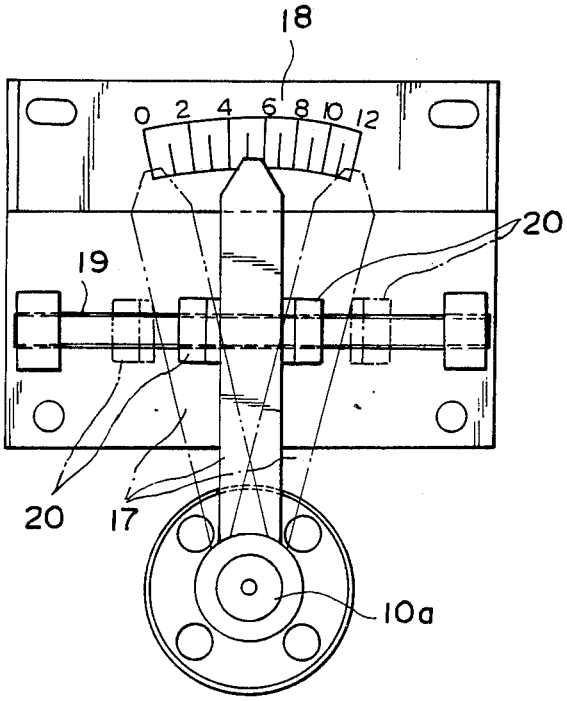
FIG. 3 is a front view of a reduced stream gate section adjusting apparatus.

The shaft portion **10*a*, as shown in FIG. 3, is provided at its one end with a pointer 17 which is integrally rotated together with the shaft portion 10*a*, and a memory 18 instructed by the pointer 17 is provided to form an adjusting apparatus, the shaft portion 10*a* being pivoted from an external portion, the instructions of the memory 18 by the pointer 17 being read, in the means time, the opening degree of the reduced stream section 9 by the circular arcuate gate portion 10*b*** is adjusted.

As means for fixing the set position of the pointer 17 and the shaft portion **10*a*, for example, both sides of the pointer 17 is supported by a nut 20 threadedly engaged with a screw shaft 19 disposed in such a manner as to transverse the pointer 17 in order to fix the position so that the shaft portion 10***b* would not be pivoted from such established position recklessly.

As described in the foregoing, according to the present invention, there is provided a head box including a dispersing section provided with numerous paper material slurry flowing pores at an inlet side of a paper material slurry passage leading to a slurry slip, a reduced stream section disposed at an outlet side of said dispersing section and which provides a reduced cross section of said paper material slurry passage, an evener chamber formed between an inlet side of said reduced stream section and an outlet side of said dispersing section, a reduced stream gate disposed at said reduced stream section and adapted to regulate the height of said reduced stream section, said reduced stream gate being disposed on a bottom surface of said reduced stream section, said reduced stream gate being provided with a shaft portion pivotable about a fixed supporting point and a circular arcuate gate portion formed in concentric with and projected from said shaft portion along a circular arcuate surface of said shaft portion, said reduced stream gate being disposed such that said circular arcuate gate portion is integrally pivoted with said shaft portion to expand an end portion of said gate into said reduced stream section from said bottom surface of said reduced stream section. Accordingly, by virtue of the cooperative action of the dispersing section and the reduced stream section, the dispersion and profile improvement can be achieved. Furthermore, the dispersing section is simplified and the reduced stream section offsets the simplicity of the dispersing section, thereby to obtain an initial object for adjusting the paper material slurry.

Moreover, by virtue of the provision of the reduced stream section, the flowing of the paper material slurry to be discharged into the evener chamber from the paper material slurry flowing pores can be bumped. Accordingly, the evening effect within the evener chamber can be increased. Furthermore, the streams of the paper material slurry discharged from the flowing pores can properly be blended and then fed to the narrow reduced stream section opened up in its entire width in the paper forming width direction. As a result, the texture adjusting effect can fully be realized at that place.

Furthermore, the reduced stream gate can properly be adjusted in accordance with operating conditions such as kind of paper material slurry, freeness, paper manufacturing speed, paper forming width, etc. and an ideal operating condition is properly selected according to necessity. That is, by selecting the most suitable flowing speed of the paper material slurry at the reduced stream section while rendering a directionarity to the entire width flowing of the paper material slurry at the dispersing section so as to enhance the dispersion, the entire width paper material slurry profile can be improved.

The present invention can realize a small and simple dispersing section by reducing the function of the conventional dispersing section in the manner as described above. As a result, no large size of a head box is invited and the manufacturing cost can be reduced.

The invention has been described with reference to a preferred embodiment. However, it will be appreciated that variations and modifications can be effected within the ordinary skill in the art without departing from the scope of the present invention.

What is claimed is:

1. A head box including a dispersing section provided with numerous paper material slurry flowing pores at an inlet side of a paper material slurry passage leading to a slurry slip, a reduced stream section having a height disposed at an outlet side of said dispersing section and which provides a reduced cross section of said paper material slurry passage, an evener chamber formed between an inlet side of said reduced stream section and an outlet side of said dispersing section, a reduced stream gate disposed at said reduced stream section and which regulates the height of said reduced stream section, said reduced stream gate being disposed on a bottom surface of said reduced stream section, said reduced stream gate being provided with a shaft portion pivotable about a fixed supporting point and a circular arcuate gate portion formed concentric with and projected from said shaft portion along a circular arcuate surface of said shaft portion, said reduced stream gate being disposed such that said circular arcuate gate portion is integrally pivoted with said shaft portion to expand an end portion of said gate into said reduced stream section from said bottom surface of said reduced stream section.

2. A head box as claimed in claim 1, wherein an end face on the expanded portion of said circular arcuate gate is formed by a plane as a tangential line interconnecting a circular arcuate surface of said shaft portion and a circular arcuate portion of said circular arcuate gate portion.

* * * * *